US006602091B2

(12) United States Patent
Belady et al.

(10) Patent No.: US 6,602,091 B2
(45) Date of Patent: Aug. 5, 2003

(54) THERMALLY ENHANCED ELECTRICAL CONNECTOR

(75) Inventors: Christian L Belady, McKinney, TX (US); Steve Belson, Plano, TX (US); Michael L. McHugh, McKinney, TX (US)

(73) Assignee: Hewlett-Packard Development Company, LP., Houston, TX (US)

( * ) Notice: Subject to any disclaimer, the term of this patent is extended or adjusted under 35 U.S.C. 154(b) by 0 days.

(21) Appl. No.: 10/016,167

(22) Filed: Oct. 29, 2001

(65) Prior Publication Data

US 2003/0082945 A1 May 1, 2003

(51) Int. Cl.[7] ..... H01R 13/00
(52) U.S. Cl. ..... 439/485; 361/704

(58) Field of Search ..... 439/485, 487; 361/704, 707, 687; 257/219; 417/423.1

(56) References Cited

U.S. PATENT DOCUMENTS 4,082,407 A * 4/1978 Smorzaniuk et al. ... 439/112 R
5,945,217 A * 8/1999 Hanrahan ..... 428/389
6,203,293 B1 * 3/2001 Yamamoto et al. ..... 439/66
6,359,780 B1 * 3/2002 McMahan et al. ..... 361/687

* cited by examiner

*Primary Examiner*—P. Austin Bradley
*Assistant Examiner*—Phuong-Chi Nguyen
(74) *Attorney, Agent, or Firm*—Leslie P. Gehman

(57) ABSTRACT

An electrical connector is constructed including heat-spreading devices in order to reduce hotspots within the connector and to efficiently dissipate heat to the surrounding atmosphere, thus increasing the current carrying capability of the connector.

13 Claims, 8 Drawing Sheets

THERMALLY ENHANCED ELECTRICAL CONNECTOR

FIELD OF THE INVENTION

The present invention relates generally to the field of electrical connectors and more specifically to the field of heat dissipation within electrical connectors.

BACKGROUND OF THE INVENTION

Many modern electronic devices, such as computers, include modular power supply connectors. These modular connectors allow easy connection and disconnection of the power supply conductors without the use of tools. Within these connections, contact resistance may result in heat build up in high current uses. Often the heat is generated at or around the contact itself, in contrast to heat being generated throughout the connector. This localized heating often results in hot spots within the connectors, and if allowed to get too hot, may result in failure of the connector due to melting of the insulating material surrounding the contact. The current carrying capability of modern connectors is often limited by this localized heating at the contact, and the connector's maximum current allowable is determined by how much heating the insulating material can withstand.

SUMMARY OF THE INVENTION

An electrical connector is constructed including heat-spreading devices in order to reduce hotspots within the connector and to efficiently dissipate heat to the surrounding atmosphere, thus increasing the current carrying capability of the connector.

Other aspects and advantages of the present invention will become apparent from the following detailed description, taken in conjunction with the accompanying drawings, illustrating by way of example the principles of the invention.

DETAILED DESCRIPTION

Figure 1A:
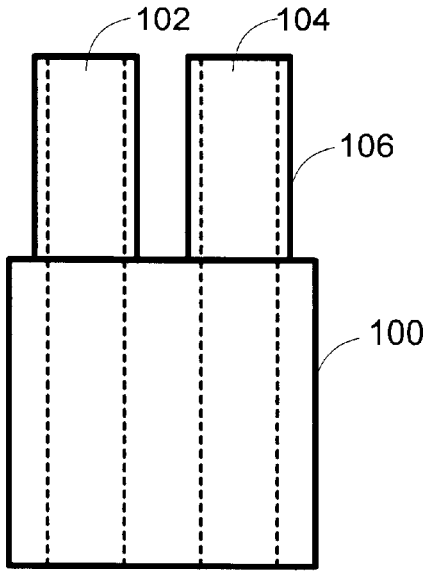
FIGS. 1A–1D are engineering drawings of an example embodiment of a electrical connector.
Figure 1B:
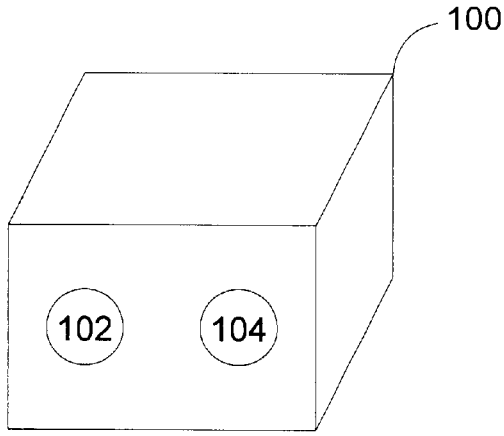
Figure 1C:
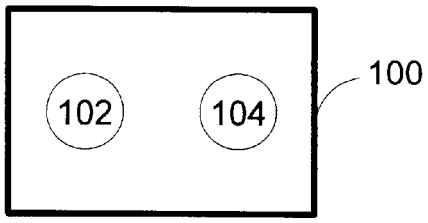
Figure 1D:
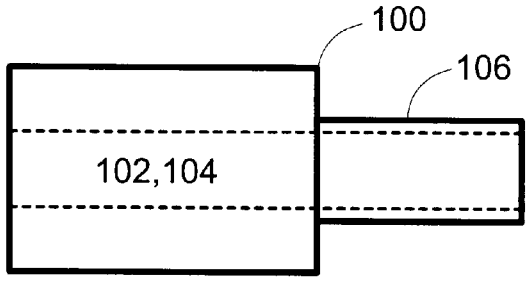
FIG. 1D Prior Art
Figure 2A:
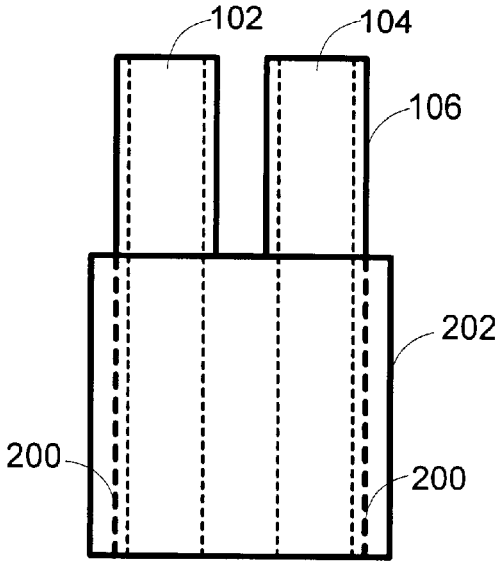
FIGS. 2A–2D are engineering drawings of an example embodiment of a thermally enhanced electrical connector according to the present invention.
Figure 2B:
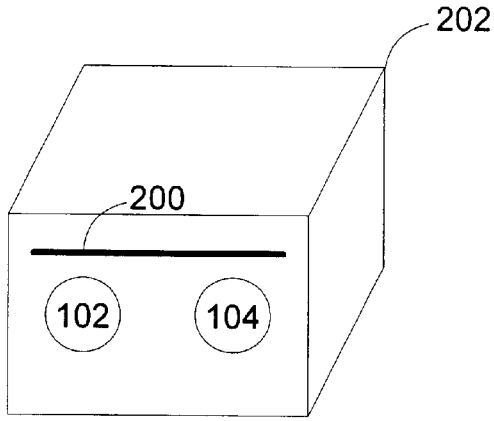
Figure 2C:
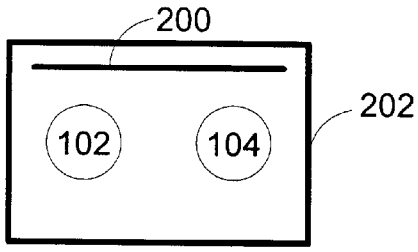
Figure 2D:
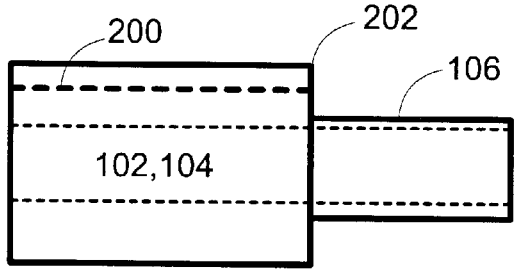
Figure 3A:
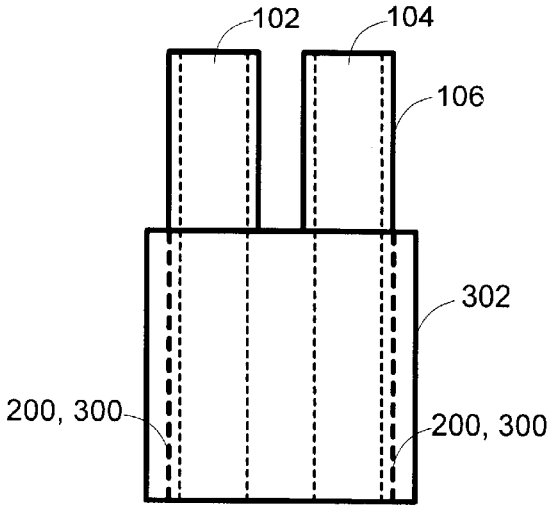
FIGS. 3A–3D are engineering drawings of an example embodiment of a thermally enhanced electrical connector according to the present invention.
Figure 3B:
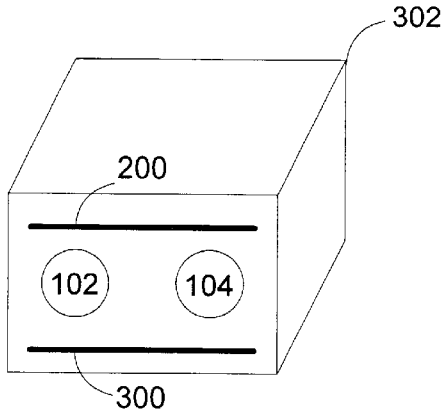
Figure 3C:
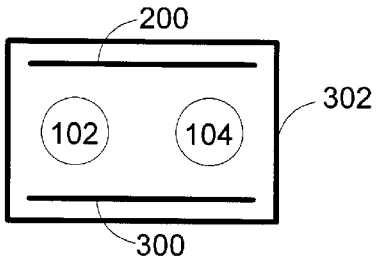
Figure 3D:
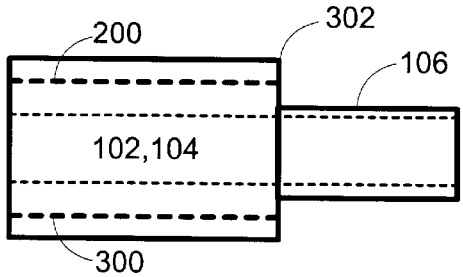
Figure 4A:
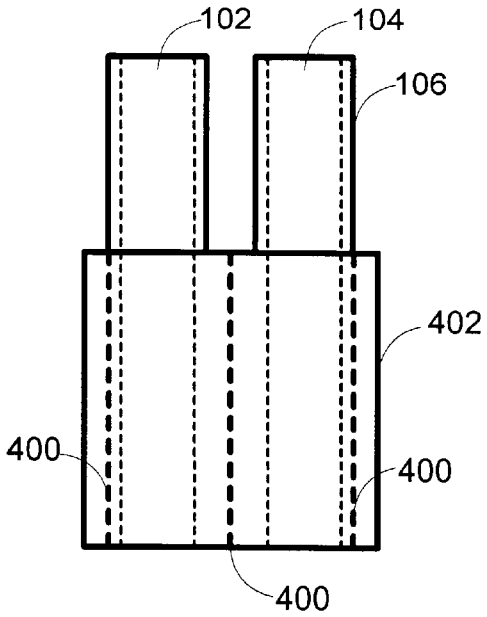
FIGS. 4A–4D are engineering drawings of an example embodiment of a thermally enhanced electrical connector according to the present invention.
Figure 4B:
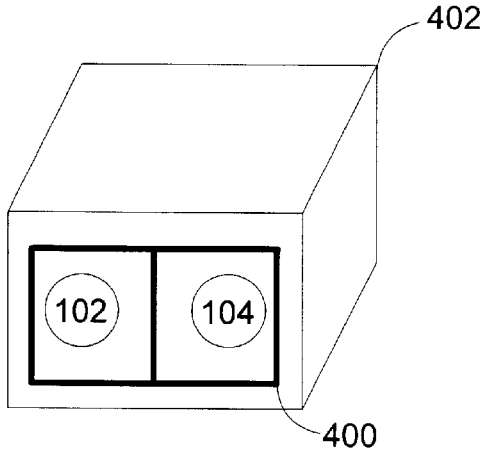
Figure 4C:
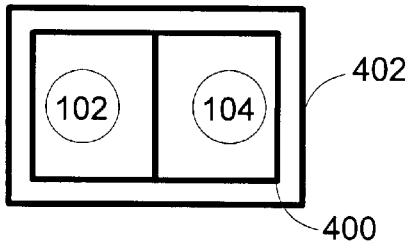
Figure 4D:
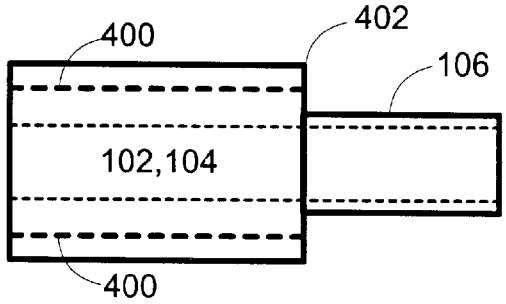
Figure 5A:
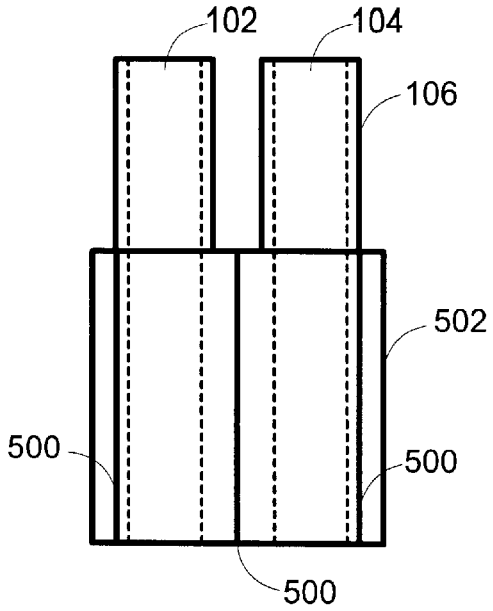
FIGS. 5A–5D are engineering drawings of an example embodiment of a thermally enhanced electrical connector according to the present invention.
Figure 5B:
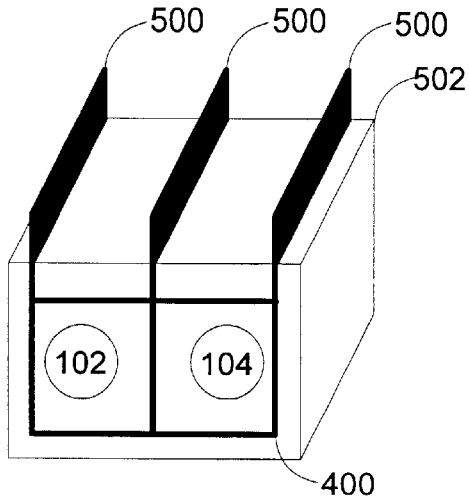
Figure 5C:
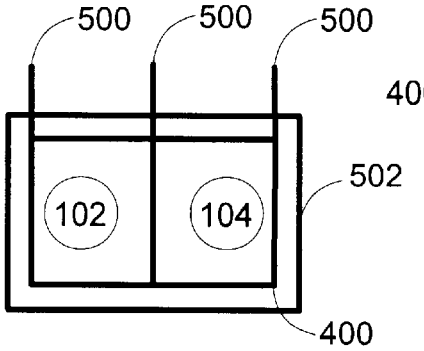
Figure 5D:
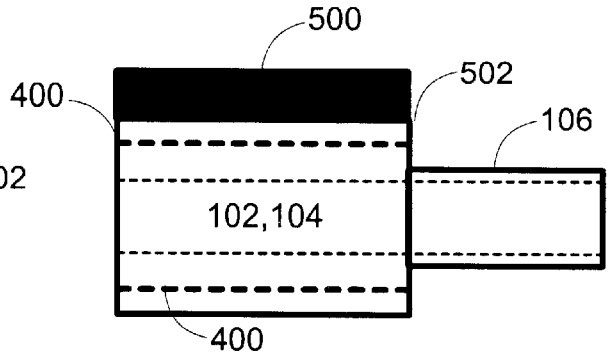

FIGS. 1A–1D are engineering drawings of an example embodiment of an electrical connector. In an example embodiment of a prior art electrical connector as shown in FIGS. 1A–1D, the connector body 100 may be constructed from plastic, ceramic, or other electrically insulating material. Two electrical connections are shown within the connector body 100, a left connection 102 and a right connection 104. Each electrical connection 102, 104 extends through a pin 106, for attachment to another connector, printed circuit board, or other electrical device. FIGS. 1A–1D include a front view, top view, side view, and perspective view of the prior art electrical connector.

FIGS. 2A–2D are engineering drawings of an example embodiment of a thermally enhanced electrical connector according to the present invention. The example embodiment of the present invention shown in FIGS. 2A–2D is an electrical connector similar to the device of FIGS. 1A–1D with the addition of a heat spreader 200 within the connector body 202. The heat spreader 200 may be made out of metal or other thermally conductive material. In the example embodiment shown in FIG. 2, the heat spreader 200 is exposed to the front and back of the connector body 202. However, in other embodiments of the present invention the connector body 202 may completely encapsulate the heat spreader 200 such that it is not externally visible. In other embodiments of the present invention the single heat spreader 200 may be physically located elsewhere within the connector body 202 such as below the left connection 102 and the right connection 104 or possibly between the two connections.

In other embodiments of the present invention, it may be desirable to load the body 202 of the connector with a thermally conductive, electrically resistive material, such as aluminum nitride. This provides a reduction in thermal resistance of the heat path from the contacts through the connector body 202, to the heat spreader. With such a thermally conductive path from the contacts to the heat spreader, the connector may handle higher currents than an equivalent connector without the thermally conductive, electrically resistive material. Alternatively, the connector body may be made completely out of a thermally conductive, electrically resistive material.

FIGS. 3A–3D are engineering drawings of an example embodiment of a thermally enhanced electrical connector according to the present invention. The example embodiment of the present invention shown in FIGS. 3A–3D is an electrical connector similar to the device of FIGS. 2A–2D with the addition of a second heat spreader 300 within the connector body 302. The heat spreaders 200, 300 may be made out of metal or other thermally conductive material. In the example embodiment shown in FIGS. 3A–3D, the heat spreaders 200, 300 are exposed to the front and back of the connector body 302. However, in other embodiments of the present invention the connector body 302 may completely encapsulate the heat spreaders 200, 300 such that they are not externally visible. In other embodiments of the present invention the two heat spreaders 200, 300 may be physically located elsewhere within the connector body 302 such as between the two connections 102, 104.

FIGS. 4A–4D are engineering drawings of an example embodiment of a thermally enhanced electrical connector according to the present invention. The example embodiment of the present invention shown in FIGS. 4A–4D is an electrical connector similar to the device of FIGS. 1A–1D with the addition of an interconnected plurality of heat spreaders 400 within the connector body 402. The plurality of heat spreaders 400 may be made out of metal or other thermally conductive material. In the example embodiment shown in FIGS. 4A–4D, the plurality of heat spreaders 400 is exposed to the front and back of the connector body 402. However, in other embodiments of the present invention the connector body 402 may completely encapsulate the mesh of heat spreaders 400 such that they are not externally visible.

FIGS. 5A–5D are engineering drawings of an example embodiment of a thermally enhanced electrical connector according to the present invention. The example embodiment of the present invention shown in FIGS. 5A–5D is an electrical connector similar to the device of FIGS. 4A–4D with the addition of heat sink fins 500 extending above the connector body 502. The heat sink fins 500 may be made out of metal or other thermally conductive material. In the example embodiment shown in FIGS. 5A–5D, the plurality of heat spreaders 400 is exposed to the front and back of the connector body 502. However, in other embodiments of the present invention the connector body 502 may completely encapsulate the plurality of heat spreaders 400 such that they are not externally visible. In some embodiment of the present invention, the heat sink fins 500 may be configured to allow physical connection to another object, such as a chassis of an electrical device. If this physical connection is thermally conductive, heat can be conducted from the heat sink fins 500 into the chassis in addition to the convective cooling obtained from airflow over the heat sink fins 500.

Figure 6:
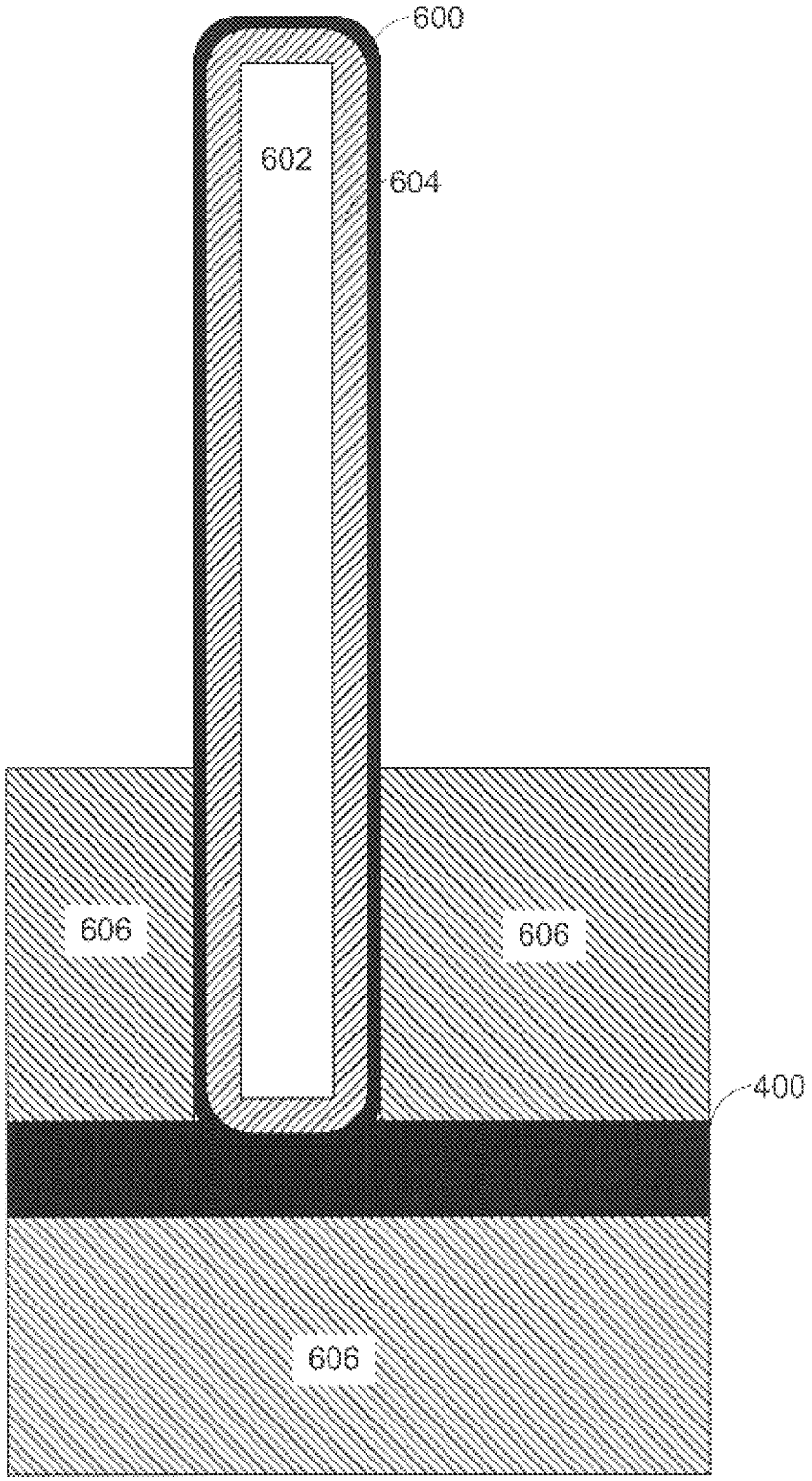
FIG. 6 is a cross sectional view of a portion of an example embodiment of a thermally enhanced electrical connector including a heat pipe used as a heat sink fin according to the present invention.

In other embodiments of the present invention, the heat sink fins 500 may comprise heat pipes. FIG. 6 is a cross sectional view of a portion of an example embodiment of a thermally enhanced electrical connector including a heat pipe 600 used as a heat sink fin according to the present invention. The heat pipe 600 comprises a vapor 602 surrounded by a wick 604 within the vessel of the heat pipe 600. Where the heat pipe 600 is thermally connected with a heat spreader 400 the liquid within the wick 604 evaporates to form a vapor 602 this heated vapor 602 rises within the heat pipe 600 to the cooler area outside of the connector body 606 where the vapor 602 condenses on the wick 604 into a liquid that then flows back down the wick 604 to the bottom of the heat pipe 600 where the process continues.

In some embodiments of the present invention, it may be desirable to electrically connect some or all of the heat spreaders to one or more of the electrical connections within the connector body 606. This may be used to keep the electrical potential on the heat spreaders and fins at ground.

Figure 7A:
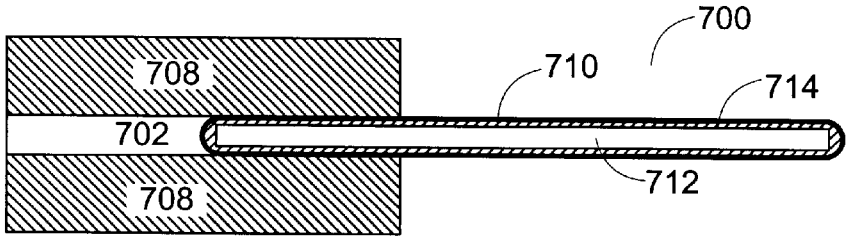
FIG. 7A is a cross-sectional view of an example embodiment of a portion of a thermally enhanced electrical connector including a heat pipe used as a pin according to the present invention.

FIG. 7A is a cross-sectional view of a portion of an example embodiment of a thermally enhanced electrical connector including a heat pipe used as a pin according to the present invention. An ideal heat pipe is an infinite thermal conductor. Due to the phase changes of the liquid to a vapor and back to a liquid at the ends of the heat pipe, the temperature is substantially constant along the length of the heat pipe. Because of these phase changes, a heat pipe is a much better thermal conductor that a solid metal pin of the same size. In an example embodiment of the present invention, a heat pipe 710 may be used as a conducting pin 700 of the electrical connector. The heat pipe 710 is similar to that described in FIG. 6 but adapted to act as the actual conducting pin 700 of the thermally enhanced electrical connector. The heat pipe 710 comprises a vapor 712 surrounded by a wick 714 within the vessel of the heat pipe 710. In the portions of the heat pipe 710 at a high temperature, the liquid within the wick 714 evaporates to form a vapor 712. This heated vapor 712 moves within the heat pipe 710 to cooler areas of the heat pipe 710 where the vapor 712 condenses on the wick 714 into a liquid that then flows back along the wick 714 to the hotter portions of the heat pipe 710 where the process continues. The signal or power supply electrically connected through the thermally enhanced connector is attached to the heat pipe pin 700 at a connection 702. This connection 702 may be a solder tab, clamp, crimped contact, or any other equivalent means for electrically connecting the signal or power supply to the heat pipe pin 700 within the thermally enhanced connector.

Figure 7B:
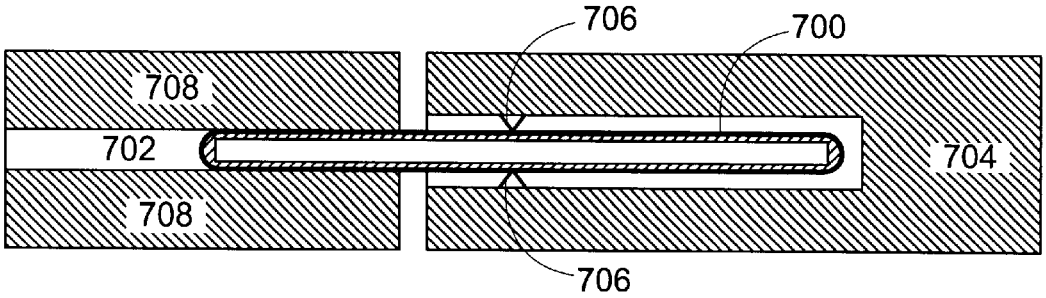
FIG. 7B is a cross-sectional view of the device of FIG. 7A connected with a mating socket.

FIG. 7B is a cross-sectional view of the device of FIG. 7A connected with a mating socket 704. The example mating socket 704 shown in FIG. 7B includes two contact points 706 where the heat pipe pin 700 is electrically connected to the mating socket 704. These contact points 706 are the likely points of heating the connector due to the contact resistance of the points 706 contacting the pin 700. In the example embodiment of the present invention, two contact points 706 are shown. However, those skilled in the art will recognize that other contact configurations may be used within the scope of the present invention. These are the high temperature points of the heat pipe 710 where the liquid within the wick 714 evaporates to form a vapor 712. The heat pipe pin 700 acts as a thermal conductor to spread the heat generated at the contact points 706 more evenly through the connector body 708 and the mating socket 704.

Figure 8:
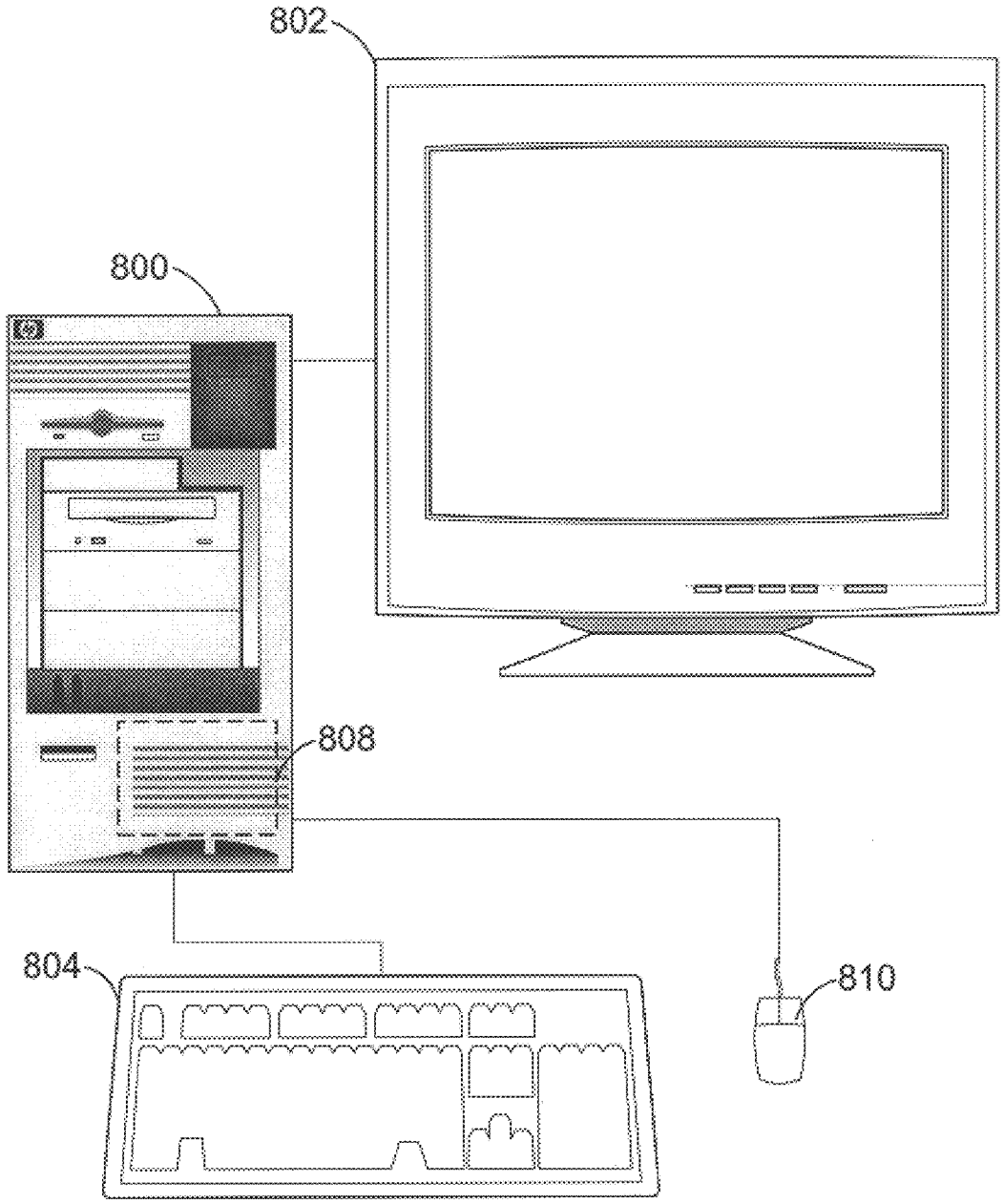
FIG. 8 is an example embodiment of a computer system including a thermally enhanced electrical connector according to the present invention.

FIG. 8 is an example embodiment of a computer system including a thermally enhanced electrical connector according to the present invention. In an example embodiment of a computer system including the present invention, a computer chassis 800, including a power supply 808 is built including at least one thermally enhanced electrical connector according to the present invention. The computer receives input from the user via a mouse 810 and a keyboard 804 and outputs information or graphics to a display 802. Many other uses of the present invention will be apparent to those of skill in the art, this is but one example usage of the present invention.

The foregoing description of the present invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. An electrical connector, comprising:

at least one electrical connection physically encapsulated at least partially within a connector body;

at least one thermally conductive heat spreader physically encapsulated at least partially within said connector body positioned to distribute heat generated from current passing through said at least one electrical connection within said connector body; and at least one heat sink fin thermally coupled with said at least one heat spreader;

wherein said heat sink fins extend outside of said connector body;

wherein said heat sink fins is configured to physically connect with a chassis, forming a thermally conductive path to said chassis.

2. An electrical connector, comprising:

at least one electrical connection physically encapsulated at least partially within a connector body:

at least one thermally conductive heat spreader physically encapsulated at least partially within said connector body positioned to distribute heat generated from current passing through said at least one electrical connection within said connector body; and at least one heat sink fin thermally coupled with said at least one heat spreader;

wherein said heat sink fins extend outside of said connector body;

wherein at least one of said at least one heat sink fins is a heat pipe.

3. An electrical connector, comprising:

at least one electrical connection physically encapsulated at least partially within a connector body; and at least one thermally conductive heat spreader physically encapsulated at least partially within said connector body positioned to distribute heat generated from current passing through said at least one electrical connection within said connector body;

wherein at least one of said heat spreaders is electrically connected to at least one of said electrical connectors.

4. An electrical connector, comprising:

at least one connection means for electrically connecting two conductors, and at least one spreader means for distributing heat generated from current passing through said connection means within a connector body wherein at least one of said heat spreader means is electrically connected to at least one of said connection means.

5. An electrical connector, comprising:

at least one electrical connection physically encapsulated at least partially within a connector body; and at least one thermally conductive heat spreader physically encapsulated at least partially within said connector body positioned to distribute heat generated from current passing through said at least one electrical connection within said connector body;

wherein said at least one heat spreaders surrounds at least one of said electrical connectors on four sides.

6. The electrical connector of clam 5, wherein all of said electrical connectors are surrounded on four sides by a plurality of heat spreaders.

7. The electrical connector of claim 5, wherein at least one of said electrical connectors are surrounded on four sides by a plurality of heat spreaders.

8. An electrical system comprising:

a chassis;

at least one electrical device enclosed within said chassis;

at least one electrical connection physically encapsulated within a connector body electrically connected to at least one of said electrical devices;

at least one thermally conductive heat spreader physically encapsulated within said connector body positioned to distribute heat generated from current passing through said at least one electrical connection within said connector body: and at least one heat sink fin thermally coupled with said at least one heat spreader, wherein said heat sink fins extend outside of said connector body.

9. The electrical system of claim 8, wherein said heat sink fins are configured to physically connect with said chassis, forming a thermally conductive path to said chassis.

10. The electrical system of claim 8, wherein at least one of said heat sink fins is a heat pipe.

11. An electrical connector, comprising:

at least one electrical connection physically encapsulated within a connector body; and at least one heat pipe pin physically encapsulated within said connector body, electrically coupled with said at least one electrical connection, configured to conduct current through a connecting socket and to distribute heat within said connector body.

12. The electrical connector of claim 11, wherein heat pipe pin is also configured to distribute heat within said connecting socket.

13. The electrical connector of claim 11, further comprising at least one thermally conductive heat spreader physically encapsulated within said connector body positioned to distribute heat generated from current passing through said at least one electrical connection within said connector body.

* * * * *